US008388182B2

(12) United States Patent
Chang

(10) Patent No.: US 8,388,182 B2
(45) Date of Patent: Mar. 5, 2013

(54) LAMP STRIP COVERING STRUCTURE

(76) Inventor: Chia-Hao Chang, New Taipei (TW)

( * ) Notice: Subject to any disclaimer, the term of this patent is extended or adjusted under 35 U.S.C. 154(b) by 174 days.

(21) Appl. No.: 13/014,810

(22) Filed: Jan. 27, 2011

(65) Prior Publication Data

US 2011/0188248 A1 Aug. 4, 2011

(30) Foreign Application Priority Data

Jan. 29, 2010 (TW) ..... 99201910 U

(51) Int. Cl.
*F21V 21/00* (2006.01)

(52) U.S. Cl. ..... 362/249.02; 362/249.04; 362/249.11; 362/249.16; 362/311.04

(58) Field of Classification Search ..... 362/249.02, 362/249.04, 249.11, 249.16, 311.04
See application file for complete search history.

(56) References Cited

U.S. PATENT DOCUMENTS

2003/0214809 A1* 11/2003 Wong ..... 362/249
2005/0092517 A1* 5/2005 Fan ..... 174/117 FF

FOREIGN PATENT DOCUMENTS

| | | | |
|---|---|---|---|
| AU | 20070240145 | A1 | 6/2009 |
| DE | 10051528 | A1 | 10/2000 |
| DE | 20216833 | U1 | 4/2004 |
| EP | 1473978 | A1 | 3/2004 |
| EP | 1813857 | A1 | 8/2007 |
| EP | 1884706 | A1 | 6/2008 |
| TW | M316972 | U | 8/2007 |

OTHER PUBLICATIONS

EP Serach Report.

* cited by examiner

*Primary Examiner* — Ali Alavi
(74) *Attorney, Agent, or Firm* — Chun-Ming Shih; HDLS IPR Services

(57) ABSTRACT

A lamp strip covering structure includes a first lead (10), a second lead (20) (10), an insulating body (30), LEDs (40), and a thermoplastic film (50). The insulating body (50) is provided with troughs corresponding to the first lead (10) and the second lead (20), thereby uncovering a first connecting section (11) of the first lead (10) and a second connecting section (21) of the second lead (20). The LEDs (40) are electrically connected to the first connecting section (11) and the second connecting section (21). The thermoplastic film (50) wraps the LEDs (40) and the insulating body (30) to cover the LEDs (40) and the insulating body (30) due to a thermal shrinkage. By this structure, the assembly and manufacturing of the lamp strip are simplified with a reduced cost. Further, the electrical connection between the LED (40) and the leads (10, 20) is maintained.

6 Claims, 6 Drawing Sheets

LAMP STRIP COVERING STRUCTURE

BACKGROUND OF THE INVENTION

1. Field of the Invention

The present invention relates to a light-emitting device, in particular to a LED lamp strip.

2. Description of Prior Art

Light-emitting diode (LED) has advantages of low power consumption, long life, small volume, and fast response time, so that it has been widely used in various light-emitting devices to replace traditional bulbs. For example, the LED may be used in a decorative lamp strip.

Taiwan Patent M316972 discloses a conventional LED lamp strip, which includes an inner fixing base, a LED set, and an outer fixing body. The LED set is constituted of a plurality of LED units, a lead assembly and a flexible circuit board. The LED set is inserted into the inner fixing base. The outer fixing body is configured to cover the inner fixing base and the LED set to form one body, thereby obtaining the lamp strip.

In the above-mentioned LED lamp strip, the LED unit has to be soldered to the flexible circuit board. Then, the outer fixing body and the inner fixing base are pressed to sandwich the LED set. Thus, the manufacturing of the conventional LED lamp strip is complicated, time-consuming and high-cost. On the other hand, after the lamp strip is bent for several times, pins of each LED of the LED set may be separated from the lead assembly to deteriorate the electrical connection and also make the lamp strip to suffer damage. Further, it is not easy to repair the LEDs because they are covered by the fixing body.

In view of the above, the present invention proposes a novel and reasonable structure based on his expert knowledge and deliberate research.

SUMMARY OF THE INVENTION

The present invention is to provide a lamp strip covering structure, in which the assembly and manufacturing thereof are simplified with a reduced cost, and the electrical connection between the LEDs and leads are maintained.

The present invention is to provide a lamp strip covering structure, including a first lead, a second lead, an insulating body, at least one LED, and a thermoplastic film. The second lead is arranged in parallel to one side of the first lead with an interval. The insulating body covers the first lead and the second lead. The insulating body is provided with troughs at positions corresponding to the first lead and the second lead, thereby uncovering a first connecting section of the first lead and a second connecting section of the second lead. The LEDs are electrically connected to the first connecting section and the second connecting section. The thermoplastic film wraps the LEDs and the insulating body to cover the LEDs and the insulating body due to thermal shrinkage.

The present invention is to provide a lamp strip covering structure, including a first lead, a second lead, an insulating body, at least one LED, a fixing frame, and a thermoplastic film. The second lead is arranged in parallel to one side of the first lead with an interval. The insulating body covers the first lead and the second lead. The insulating body is provided with troughs at positions corresponding to the first lead and the second lead, thereby uncovering a first connecting section of the first lead and a second connecting section of the second lead. The LEDs are electrically connected to the first connecting section and the second connecting section. The fixing frame is configured to fix the LEDs in position. The thermoplastic film wraps the LEDs and the insulating body to cover the LEDs and the insulating body due to thermal shrinkage.

Further, the present invention is to provide a lamp strip covering structure having a waterproof effect. The insulating body is provided with a notch outside the LED. The thermoplastic film is formed with a stopping portion to be inserted into the notch, so that moisture can be collected in the notch. By this structure, the moisture can be prevented from reaching the LEDs to deteriorate the electrical property of the lamp strip.

In comparison with prior art, according to the lamp strip covering structure of the present invention, the thermoplastic film covers the LEDs and the insulating body. Then, the thermoplastic film is subjected to a hot working process to shrink so as to wrap the LEDs and the insulating body. In comparison with the pressing process used in prior art, the present invention can reduce the production cost greatly. Further, the thermoplastic film wraps the LEDs to stably maintain the electrical connection between the LEDs and the leads. The thermoplastic film is provided with a stopping portion at a position corresponding to the notch of the insulating body, so that the moisture can be collected in the notch without reaching the LEDs to deteriorate the electrical property of the lamp strip. Thus, the present invention has a good waterproof effect. Furthermore, the lamp strip of the present invention has an excellent flexibility, so that it can be bent as a wrist ring or other shape. Therefore, the present invention has improved practicability and convenience in use.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
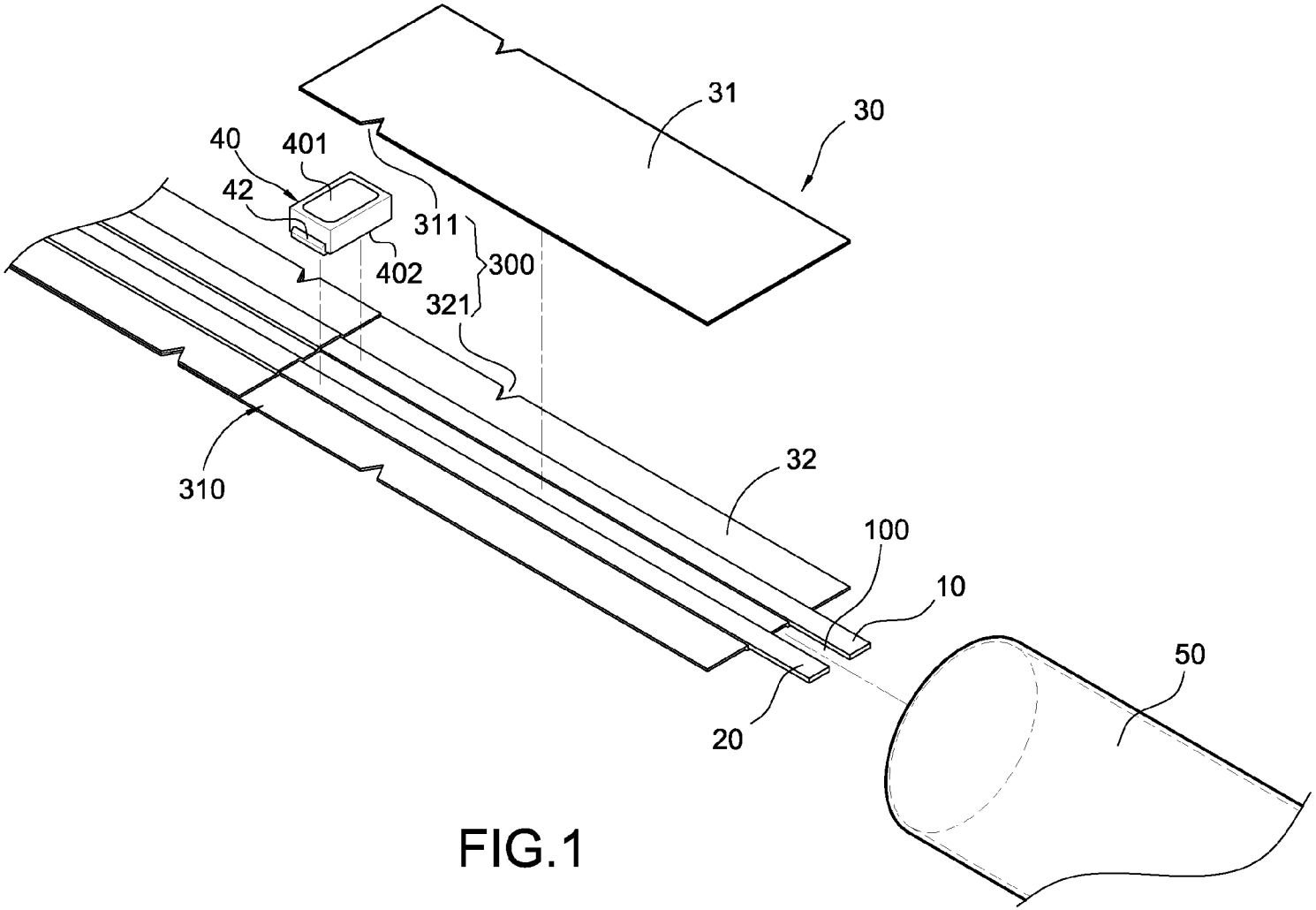
FIG. 1 is an exploded perspective view showing a lamp strip covering structure of the present invention.
Figure 2:
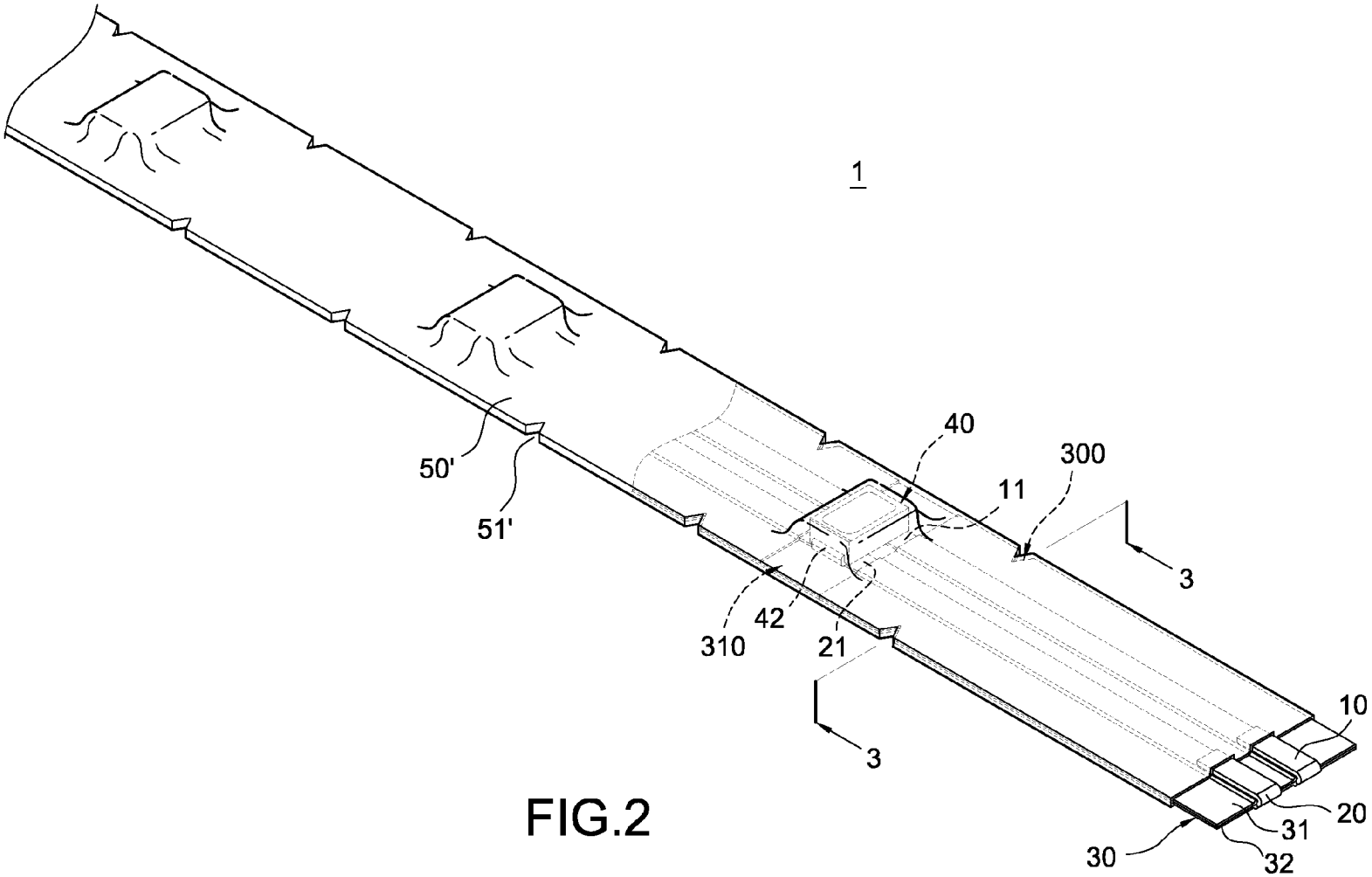
FIG. 2 is a schematic view showing the external appearance of the lamp strip covering structure of the present invention.
Figure 3:
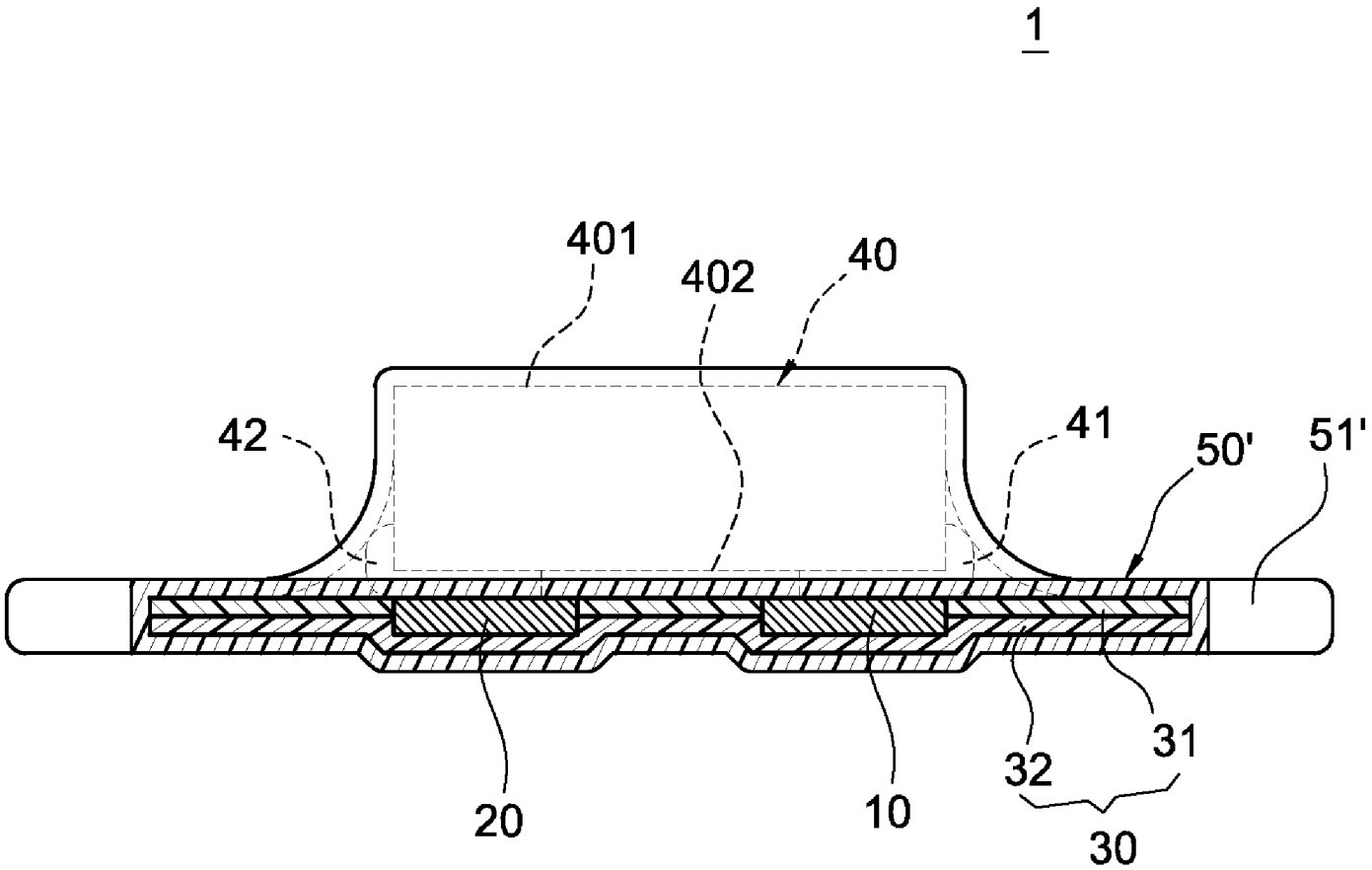
FIG. 3 is an assembled cross-sectional view of FIG. 2 taken along the line 3-3.

Please refer to FIGS. 1 to 3. FIG. 1 is an exploded perspective view of the lamp strip covering structure of the present invention. FIG. 2 is a schematic view showing the external appearance of the lamp strip covering structure of the present invention. FIG. 3 is an assembled cross-sectional view of FIG. 2. The present invention provides a lamp strip 1, which includes a first lead 10, a second lead 20, an insulating body 30, at least one LED 40, and a thermoplastic film 50.

The second lead 20 is arranged in parallel to one side of the first lead 10 with an interval. That is, a pitch 100 is formed between the first lead 10 and the second lead 20. The insulating body 30 covers the first lead 10 and the second lead 20. The insulating body 30 has an upper layer 31 and a lower layer 32 for covering the first lead 10 and the second lead 20. The insulating body 30 is provided with a trough 310 at positions corresponding to the first lead 10 and the second lead 20, thereby uncovering a first connecting section 11 of the first lead 10 and a second connecting section 21 of the second lead 20. In the present embodiment, the upper layer 31 and the lower layer 32 are formed into one unit by means of a hot pressing process.

The LED 40 is a SMD (Surface Mounted Device) LED and has a light-emitting surface 401, a backlight surface 402, a first electrode 41 and a second electrode 42. The LED 40 is disposed on the first connecting section 11 and the second connecting section 21, so that the first electrode 41 is electrically connected to the first connecting section 11 and the second electrode 42 is electrically connected to the second connecting section 21. In this way, the LED 40 is electrically connected to the first lead 10 and the second lead 20. The upper layer 31 is provided with a notch 311, and the lower layer 32 is provided with a notch 321. After a hot pressing process, the insulating body 30 is formed with a notch 300 outside the LED 40.

The thermoplastic film 50 is made by light-transmitting materials such as polyvinylchloride (PVC), polyethylene (PE), polyethylene terephthalate (PET) or the like. The thermoplastic film 50 wraps the LED 40 and the insulating body 30 to cover the outer surfaces of the LED 40 and the insulating body 30 due to a thermal shrinkage. After the thermoplastic film 50' wraps the notch 300 of the insulating body 30, the thermoplastic film 50' is formed with a stopping portion 51' at a position corresponding to the notch 300. The stopping portion 51' is configured to block the moisture. When the moisture enters the thermoplastic film 50, the moisture flows in a gap between the thermoplastic film 50 and the insulating body 30. With the notch 300 and the stopping portion 51', the moisture can be collected in the notch 300 of the insulating body 30 without reaching the LED 40. Thus, the electrical property of the LED 40 will not be deteriorated.

Figure 4:
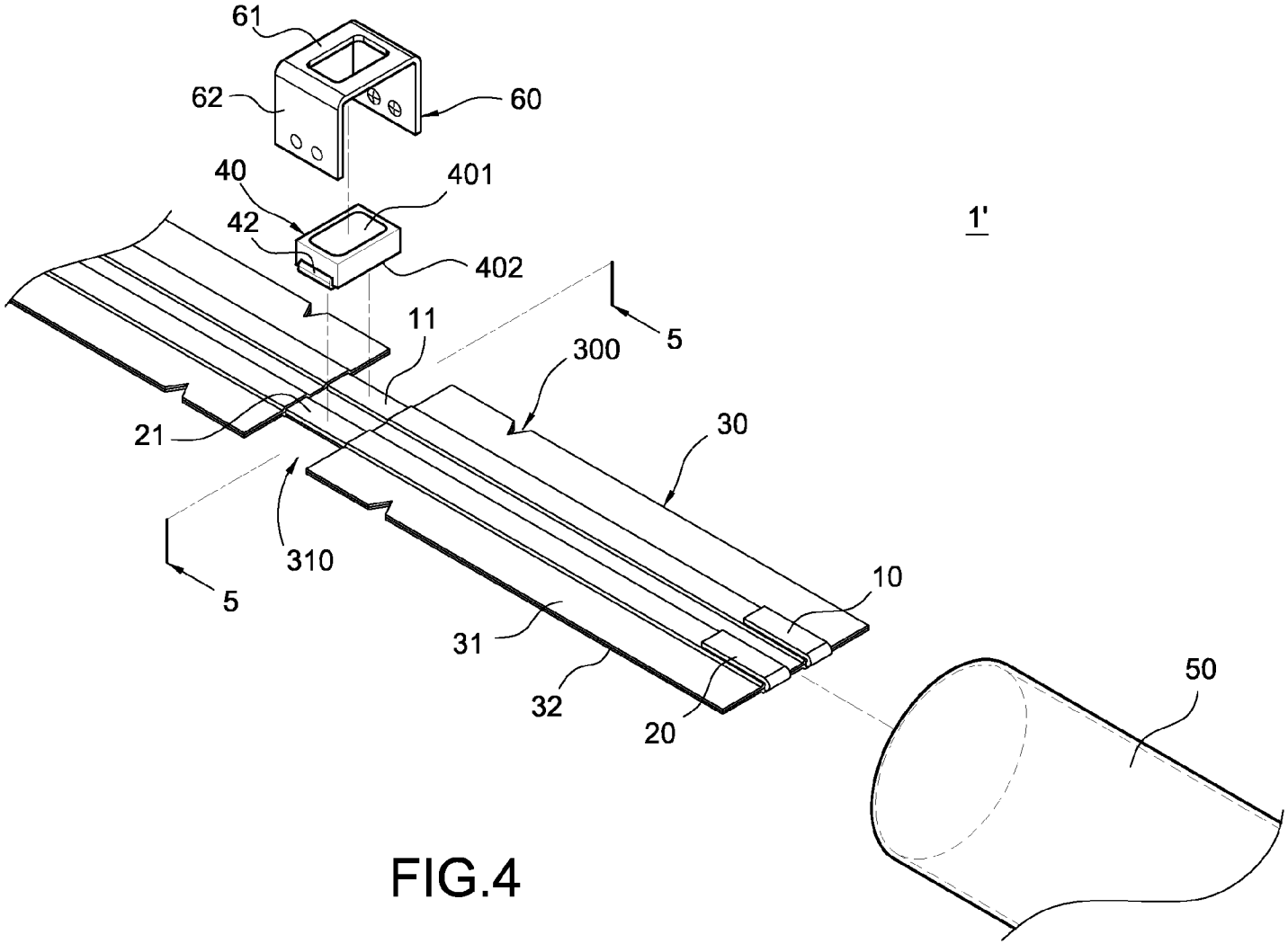
FIG. 4 is an exploded perspective view showing a second embodiment of the present invention.
Figure 5:
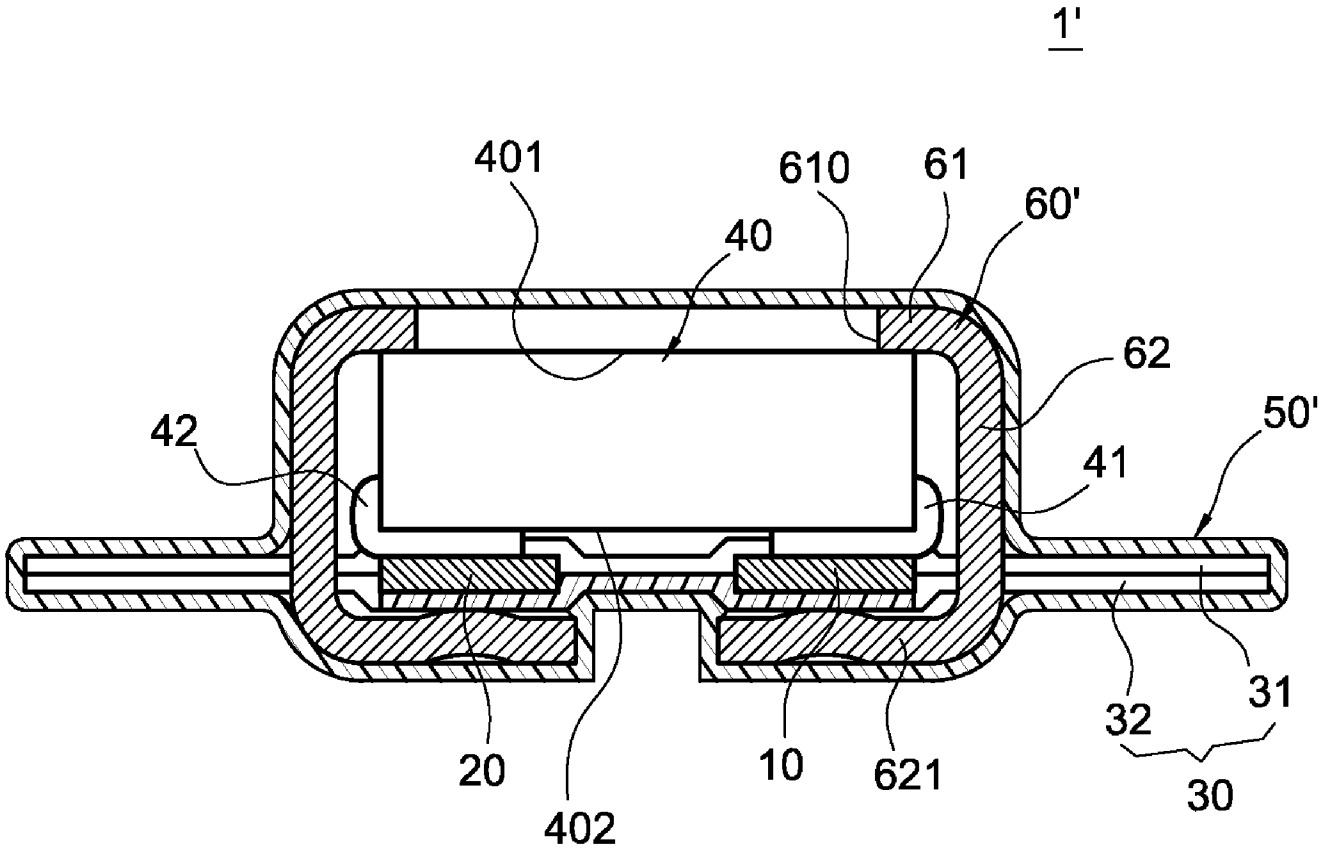
FIG. 5 is an assembled cross-sectional view showing the second embodiment of the present invention.

Please refer to FIGS. 4 and 5, which are an exploded perspective view and an assembled cross-sectional view showing the second embodiment of the lamp strip covering structure of the present invention respectively. The second embodiment is substantially the same as the first embodiment except for the connection among the LED 40 of the lamp strip 1', the first lead 10 and the second lead 20. In the present embodiment, a fixing frame 60 is provided to fix the LED 40. The fixing frame 60 may be a metallic frame including a fixing plate 61 and two side plates 62 vertically extending from both sides of the fixing plate 61. The fixing plate 61 is provided with a through-hole 610 at a position corresponding to the light-emitting surface 401 of the LED 40. The two side plates 62 of the fixing frame 60 are bent inwardly to form a stopping piece 621 respectively. The two stopping pieces 621 of the fixing frame 60' are configured to stop outside the backlight surface 402 of the LED 40. The fixing frame 60 is used to replace a soldering process for fixation.

Figure 6:
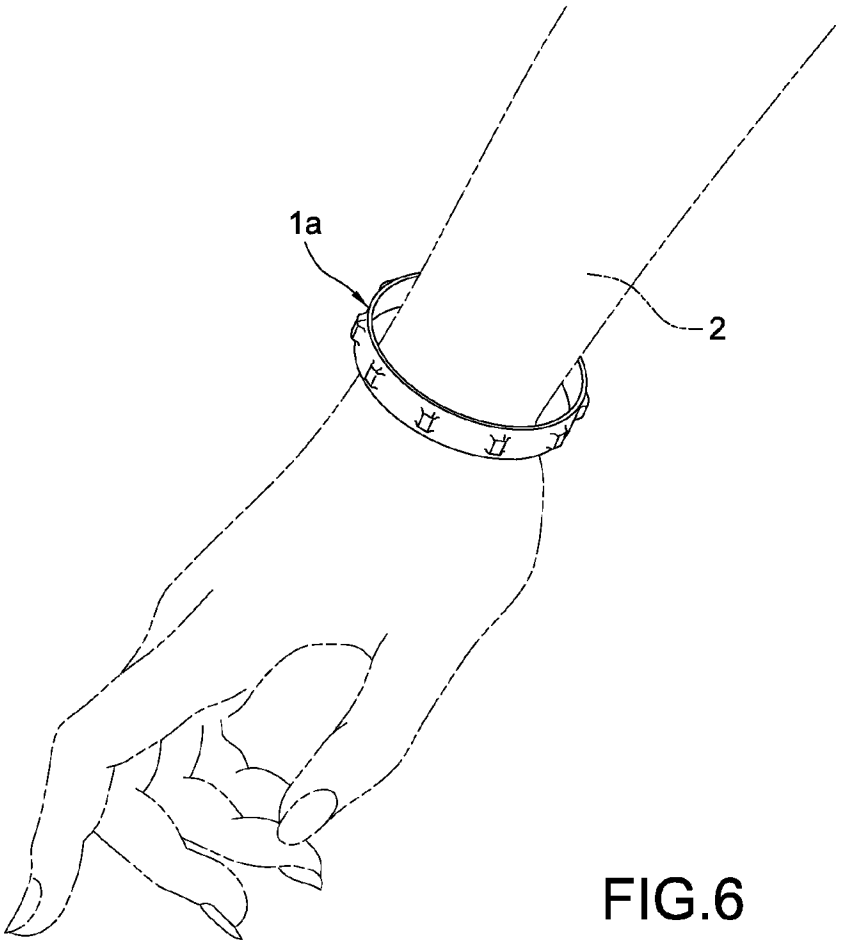
FIG. 6 is a schematic view showing the application of the lamp strip covering structure of the present invention.

Please refer to FIG. 6, which is a schematic view showing the application of the lamp stripe covering structure of the present invention. The lamp stripe may be bent to form a light-emitting wrist ring 1*a*. A user can put the light-emitting wrist ring 1*a* on his/her wrist, thereby generating a shining effect.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A lamp strip covering structure, including:

a first lead;

a second lead arranged in parallel to one side of the first lead with an interval;

an insulating body covering the first lead and the second lead, the insulating body being provided with a first trough at positions corresponding to the first lead and the second lead to thereby uncovering a first connecting section of the first lead and a second connecting section of the second lead;

at least one LED electrically connected to the first connecting section and the second connecting section;

a fixing frame configured to fix the LED in position; and a thermoplastic film wrapping the LED and the insulating body to cover the LED and the insulating body due to a thermal shrinkage, wherein the LED has a light-emitting surface and a backlight surface, the fixing frame includes a fixing plate and two side plates vertically extending from both sides of the fixing plate, the fixing plate is provided with a through-hole to correspond to the light-emitting surface, the two side plates extend inwardly to form a stopping piece respectively, the two stopping pieces are configured to stop outside the backlight surface.

2. The lamp strip covering structure according to claim 1, wherein the insulating body is provided with a second notch outside the LED, the thermoplastic film is formed with a stopping portion at a position corresponding to the second notch.

3. The lamp strip covering structure according to claim 1, wherein the insulating body has an upper layer and a lower layer for covering the first lead and the second lead, the upper layer and the lower layer are subjected to a hot pressing process to form one unit.

4. The lamp strip covering structure according to claim 1, wherein the LED has a first electrode electrically connected to the first connecting section and a second electrode electrically connected to the second connecting section.

5. The lamp strip covering structure according to claim 1, wherein the fixing frame is a metallic frame.

6. The lamp strip covering structure according to claim 1, wherein the thermoplastic film is made of a material selected from a group including polyvinylchloride, polyethylene (PE), and polyethylene terephthalate (PET).

* * * * *